US011426769B1

(12) United States Patent
Daranuta

(10) Patent No.: US 11,426,769 B1
(45) Date of Patent: Aug. 30, 2022

(54) TROWEL CLEANER

(71) Applicant: Vitalie Daranuta, Santa Rosa Beach, FL (US)

(72) Inventor: Vitalie Daranuta, Santa Rosa Beach, FL (US)

( * ) Notice: Subject to any disclaimer, the term of this patent is extended or adjusted under 35 U.S.C. 154(b) by 194 days.

(21) Appl. No.: 16/721,178

(22) Filed: Dec. 19, 2019

(51) Int. Cl.
*B08B 1/00* (2006.01)
*E04F 21/16* (2006.01)

(52) U.S. Cl.
CPC ..... *B08B 1/005* (2013.01); *E04F 21/161* (2013.01)

(58) Field of Classification Search
CPC ..... B08B 1/005; E04F 21/161; A47L 13/02; B24D 15/02; A63H 33/084
USPC ..... 15/236.01, 5, 6, 8, 9, 237; D32/46, 47; 451/451, 552; 446/124, 125
See application file for complete search history.

(56) References Cited

U.S. PATENT DOCUMENTS

| | | | | |
|---|---|---|---|---|
| 421,413 | A | 2/1890 | Loose | |
| 1,040,849 | A | 10/1912 | Bercha | |
| 1,458,018 | A | 6/1923 | Alsager | |
| 2,002,484 | A | 5/1935 | Zimmerman | |
| 2,036,527 | A | 4/1936 | Inman | |
| 2,437,298 | A | 3/1948 | Heyman | |
| 2,553,242 | A | 5/1951 | Dombitsky | |
| 2,824,330 | A * | 2/1958 | Williams | E04F 21/06 15/245.1 |
| 4,803,750 | A | 2/1989 | Christopher et al. | |
| D341,299 | S | 11/1993 | Gomez | |
| 5,839,152 | A | 11/1998 | Kruskamp | |
| 7,284,556 | B2 | 7/2007 | Chou | |
| 8,365,344 | B1 | 2/2013 | Neu | |
| 2005/0178403 | A1 | 8/2005 | Amos | |
| 2009/0117815 | A1 * | 5/2009 | Hiraide | A63H 33/086 446/124 |
| 2019/0133291 | A1 | 5/2019 | Kirshevski | |

OTHER PUBLICATIONS

Exercise Mat found at: https://www.amazon.com/Health-Fitness-Puzzle-Exercise-Interlocking/dp/B07RCLLD2F, https://www.amazon.com/Sivan-Health-Fitness-Exercise-Interlocking/product-reviews/B00U0HJCB6/ref=cm_cr_dp_d_show_all_btm?ie=UTF8&reviewerType=all_reviews (Year: 2016).*

Wooden Block found at:https://www.amazon.com/HABA-Sounds-Discovery-Acoustic-Germany/dp/B00BF3CK90/ref=as_li_ss_tl?dchild=1&keywords=haba&m=A2YMC6754W57QF&qid=1608698224&s=merchant-items&sr=1-3&linkCode=ll1&tag=sm-sensory-2 (Year: 2016).*

* cited by examiner

*Primary Examiner* — Joseph J Hail
*Assistant Examiner* — Caleb Andrew Holizna
(74) *Attorney, Agent, or Firm* — Peter Loffler

(57) ABSTRACT

A trowel cleaning device cleans mortar that has set on the serrated edge of the trowel. The trowel cleaner uses a rectangular solid block member that has a ridge pattern on at least the first face and can also be included on one or more additional faces of the block up to all six of its faces. Each ridge pattern corresponds to a serration pattern on a trowel in both size and shape so that as the serrated edge of the trowel is pulled through the ridge pattern, the ridge pattern scrapes off any mortar that has set onto the serrated edge.

7 Claims, 9 Drawing Sheets

TROWEL CLEANER

BACKGROUND OF THE INVENTION

1. Field of the Invention

The present invention relates to a cleaner through which a mortar spreading trowel is run so as to clean the trowel of any mortar that has set upon the serrated edge of the trowel.

2. Background of the Prior Art

When setting a finishing material, such as tile or stone, onto a base surface, such as a floor or a wall surface, a bonding material is used to bind the finishing material to the base surface. Most often, a mortar called thinset is used to permanently bond the finishing material to the base surface. Thinset is a cement-based material that spreads relatively easy and has a reasonably long set up time to allow the installer to properly position the finishing material onto the base surface. The mortar is either premade and brought to the jobsite, or more often, is prepared onsite by the installer and spread onto the base layer and once so spread, the finishing material is positioned onto the spread mortar as desired.

In order to spread the mortar onto the base surface, a tile trowel is used. A tile trowel is a relatively flat plate member that has at least one edge with serrations thereon. The serrated edge allows the mortar to be spread with a series of ridges in the surface of the mortar, the ridges placed therein by the notches that form the serrated edge of the trowel. When a tile or stone is pressed onto the mortar, the mortar spreads out to cover the entire undersurface of the tile or stone in order to assure a solid bond between the base surface and the finishing material without any hollow spots that can lead to cracking of the finishing material.

The notches along the serrated edge of the trowel are either U-shaped, rectangular-shaped, or triangle-shaped, depending on how much coverage is desired and can vary in both width and depth. The particular shape and size of the notches is dependent on the size of the finishing material being laid down as well as the material composition of the finishing material as well as the orientation of the base surface. Often, a tile manufacturer offers a recommendation as to the size and shape of the notches to be used for a particular product to be laid.

At the end of the day, the trowel needs to be cleaned so that the serrated edge is clean so as to be able to properly spread the mortar at the next job. While some tile installers clean their trowel as they go by hosing the trowel off after each use, many do not as they are focused on positioning the tile onto the freshly spread mortar before the mortar is too set to properly adhere to the tile. Additionally, at many job sites, such as new construction, a source of water may not be readily available to hose the trowel off before the mortar has set on the trowel. Therefore, many installers resign themselves to allowing the mortar to set onto the trowel and thereafter cleaning the trowel as needed.

The problem with cleaning the trowel after the mortar has set onto the trowel lies in the fact that mortar is not water soluble so that soaking the trowel in a bucket of water and them wiping the trowel off is not an option. Therefore, installers resort to scraping the mortar off of the serrated edge of the trowel with a chisel, knife, screwdriver or other similar implement. This tried and true method of trowel cleaning is time-consuming and relatively labor intensive and if the installer is not careful, can also lead to injury.

Additionally, it is often difficult to get the entire serrated edge free of the mortar especially when the notches are relatively small or are triangular in shape.

What is needed is a device that allows the serrated edge of the trowel to be quickly and easily cleaned of any mortar that has set upon this serrated edge. Such a device must allow for removal of the vast majority of the mortar from the working portion of the serrated edge so that the trowel can lay down a properly ridged layer of mortar upon its next use. Such a device must be relatively inexpensive to obtain and use.

SUMMARY OF THE INVENTION

The trowel cleaner of the present invention addresses the aforementioned needs in the art by providing a device that quickly and easily cleans the working portion of the serrated edge of the trowel without the need to scrape or chisel the mortar off of the trowel. The trowel cleaner is relatively simple in design and construction, being produced using standard manufacturing techniques, so as to be relatively inexpensive to produce so as to be economically attractive to potential consumers for this type of device.

The trowel cleaner of the present invention is comprised of a rectangular solid body member that a first face and an opposing fourth face, a second face and an opposing sixth face, and a third face and an opposing fifth face. A first uniform ridge pattern is located on the first face and extends between either the third face and the fifth face or between the second face and the sixth face. A uniform fourth ridge pattern may be located on the fourth face and extends between either the third face and the fifth face or between the second face and the sixth face. A second uniform ridge pattern may be located on the second face and extends between either the first face and the fourth face or between the third face and the fifth face while a third uniform ridge pattern is located on the third face and extends between either the first face and the fourth face or between the second face and the sixth face while a fifth uniform ridge pattern is located on the fifth face and extends between either the first face and the fourth face or between the second face and the sixth face while a sixth uniform ridge pattern is located on the sixth face and extends between either the first face and the fourth face or between the third face and the fifth face. The body member may be in the shape of a cube with all sides relatively equal in size.

BRIEF DESCRIPTION OF THE DRAWINGS

Similar reference numerals refer to similar parts throughout the several views of the drawings.

DESCRIPTION OF THE PREFERRED EMBODIMENT

Figure 1:
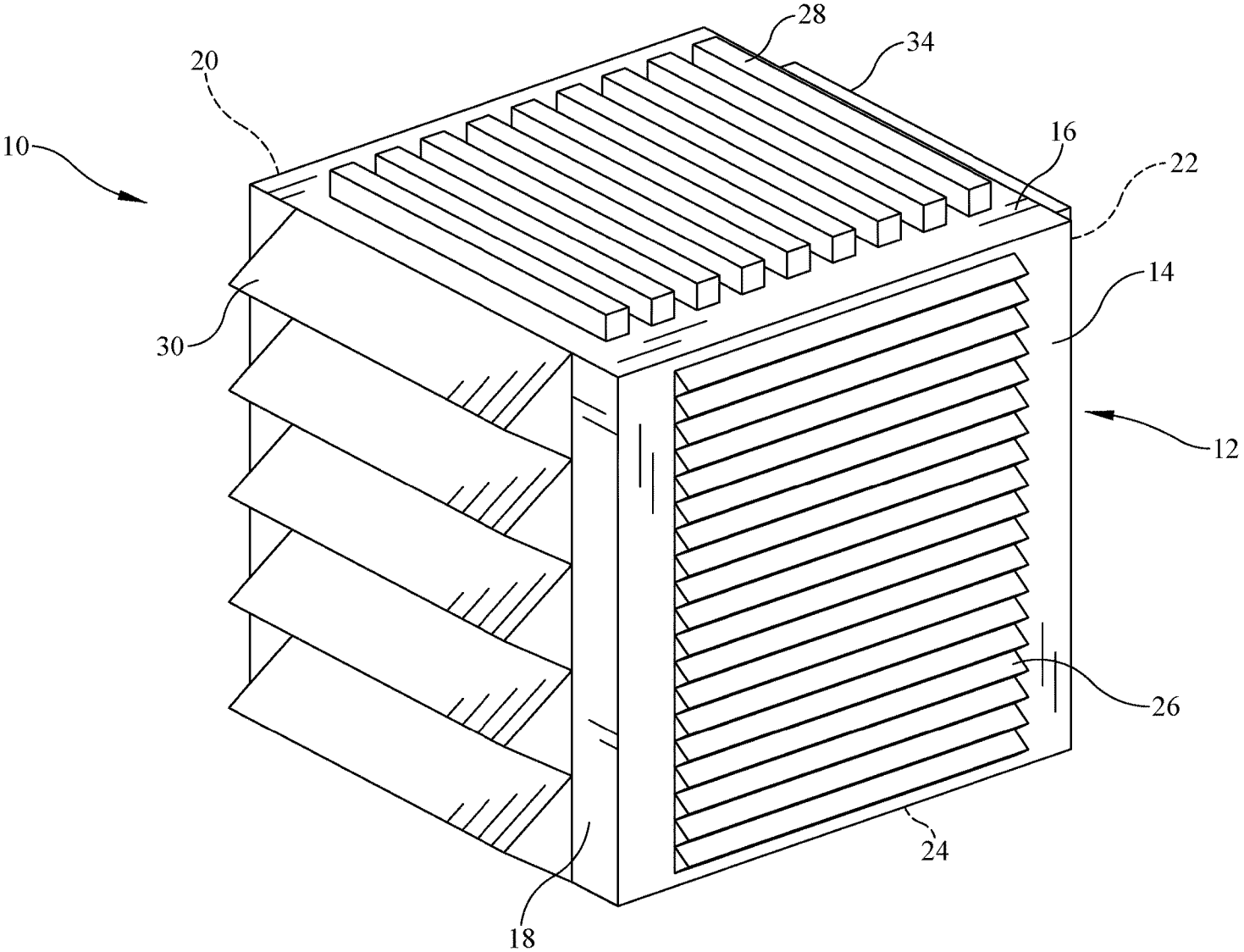
FIG. 1 is a perspective view of the trowel cleaner of the present invention.
Figure 2:
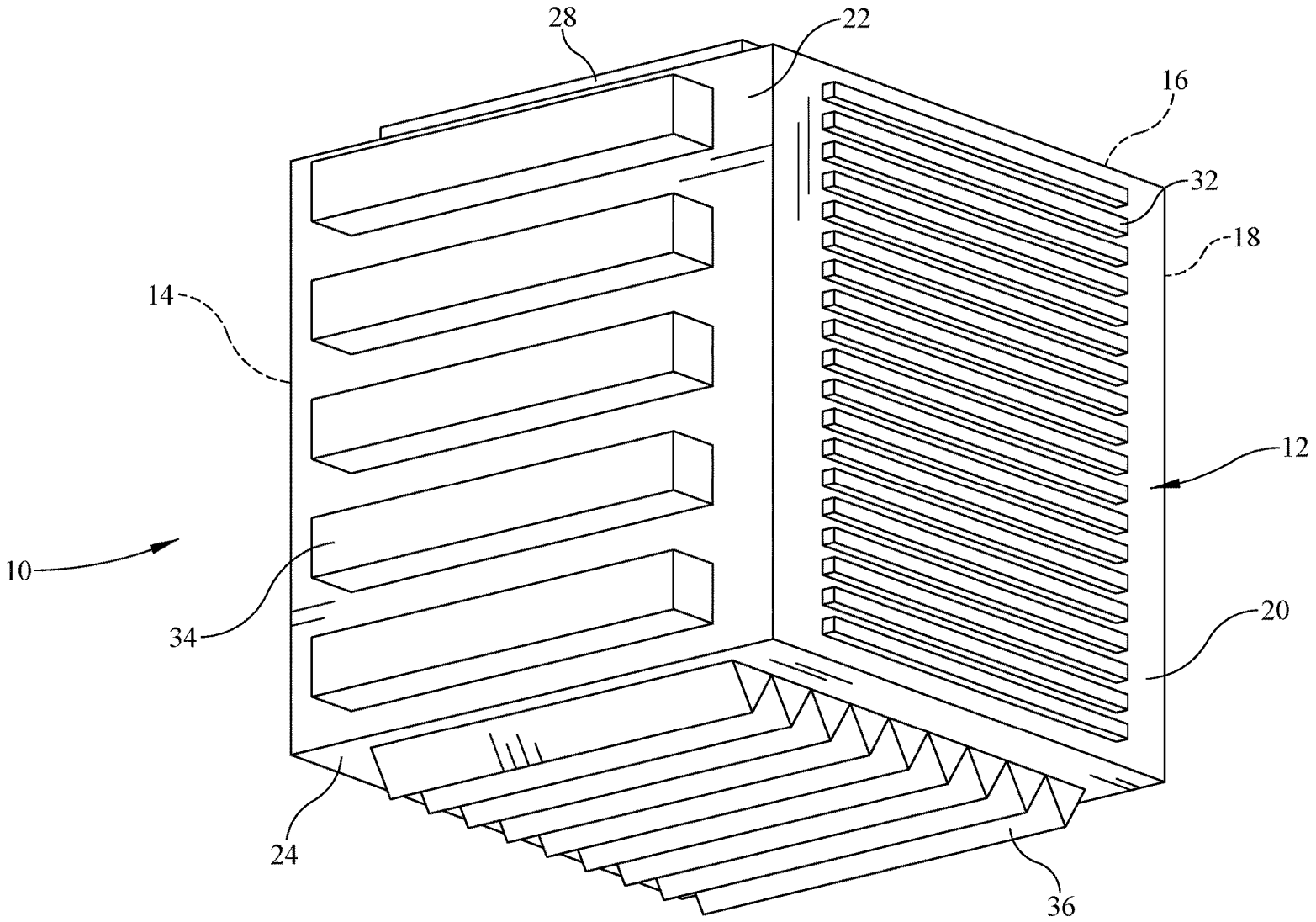
FIG. 2 is an alternate perspective view of the trowel cleaner.
Figure 3:
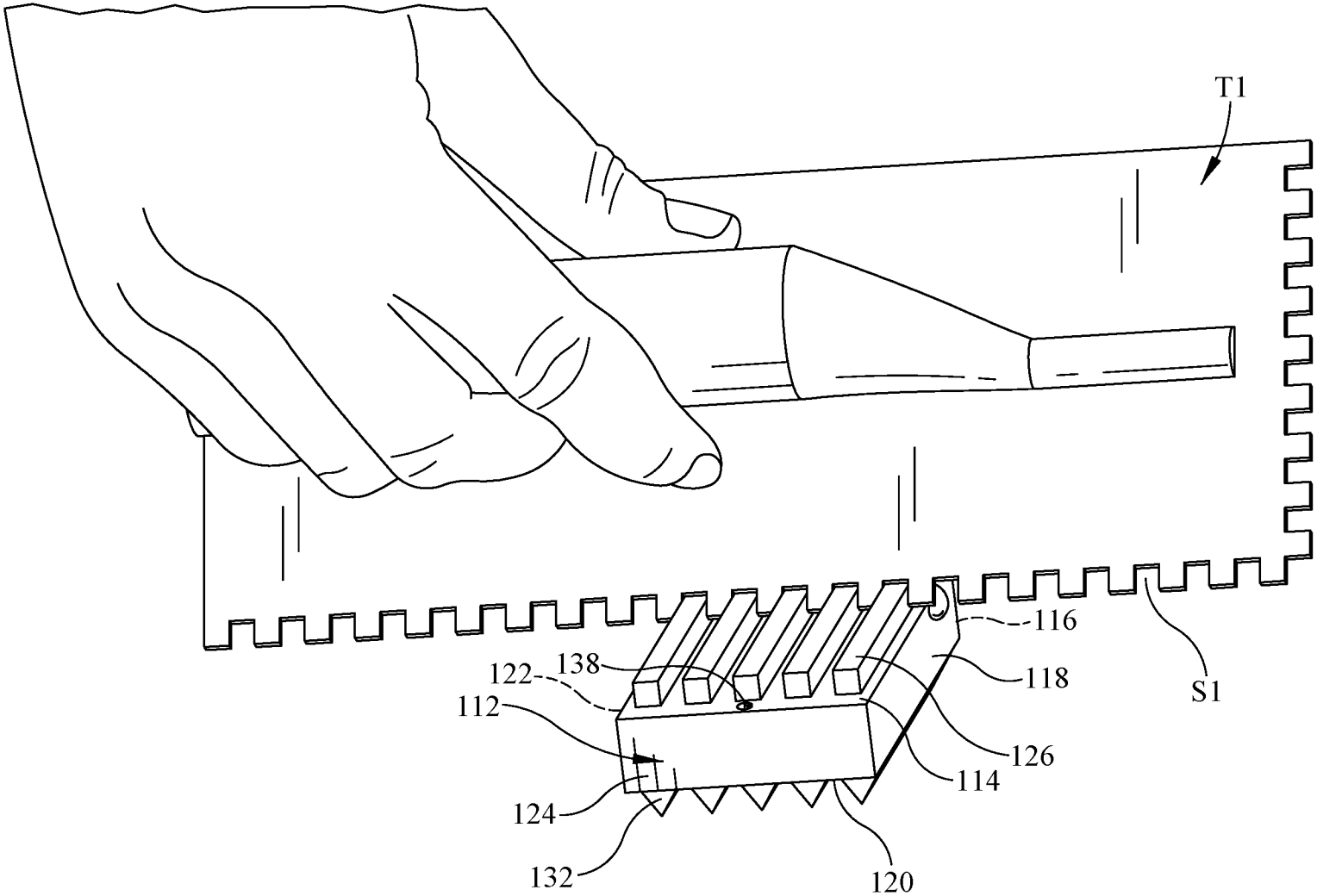
FIG. 3 is an environmental view of a first block of an alternate embodiment of the trowel cleaner of the present invention.
Figure 4:
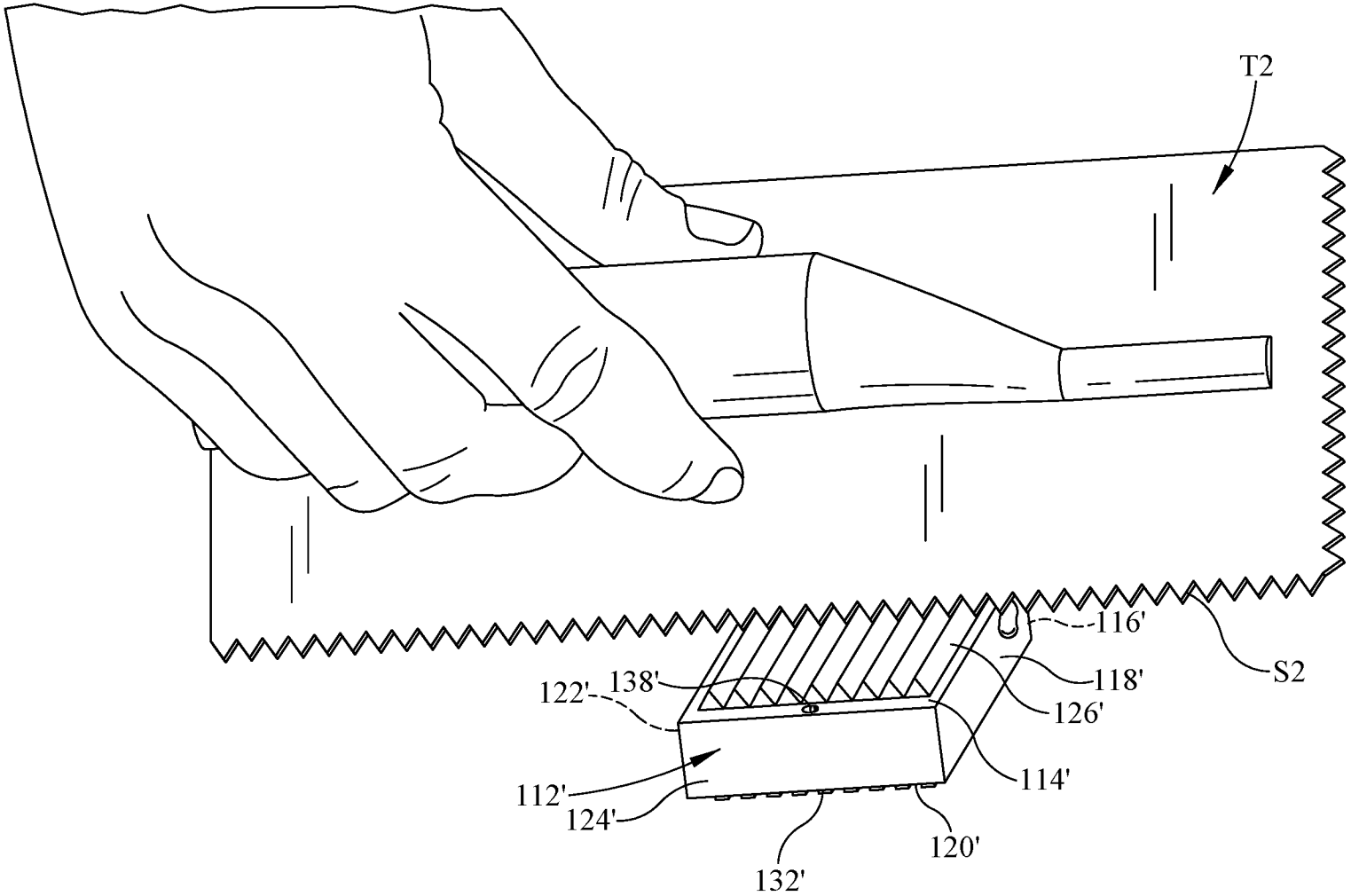
FIG. 4 is an environmental view of a second block of the alternate embodiment of the trowel cleaner.
Figure 5:
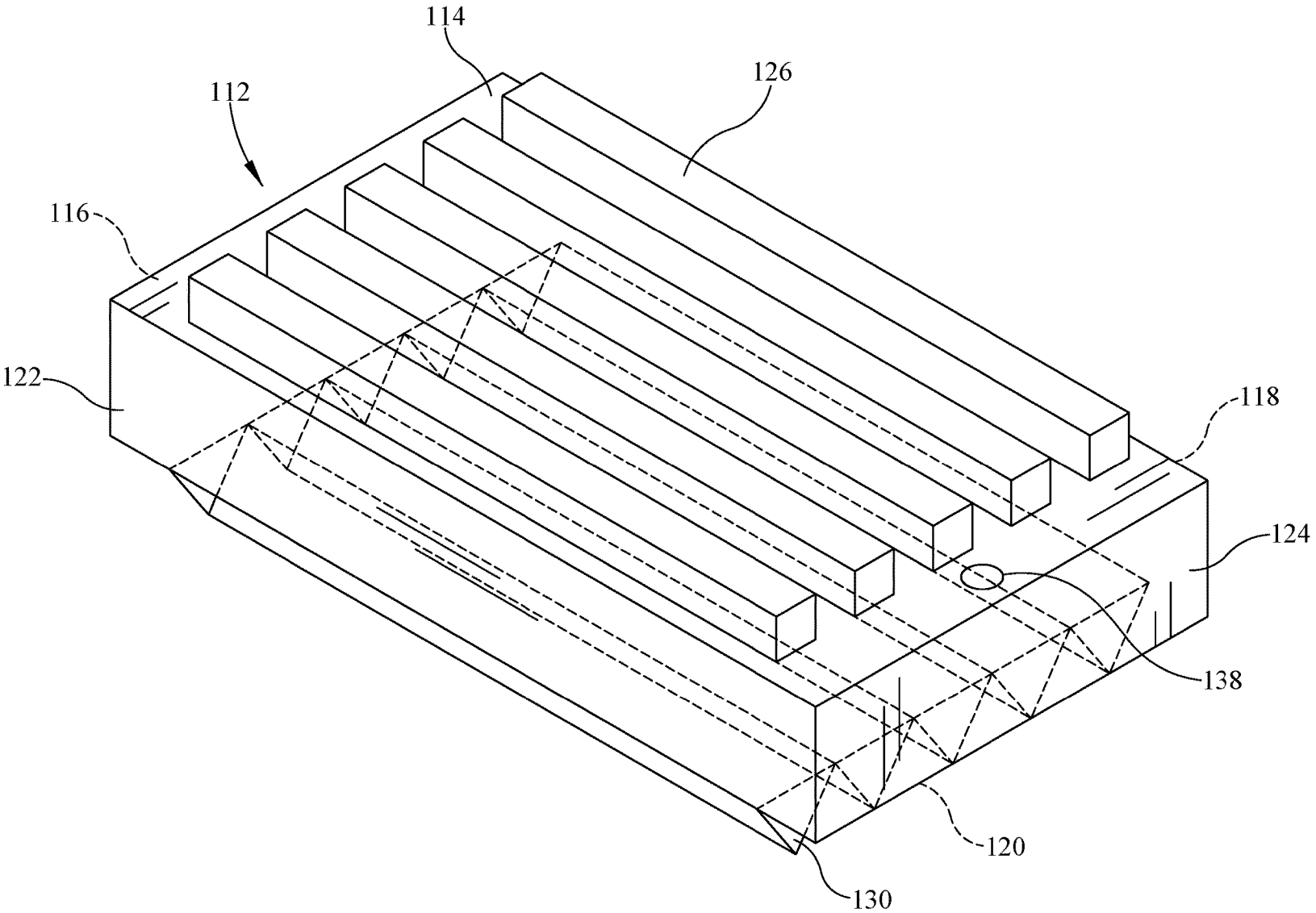
FIG. 5 is a perspective view of the first block of the alternate embodiment of the trowel cleaner.
Figure 6:
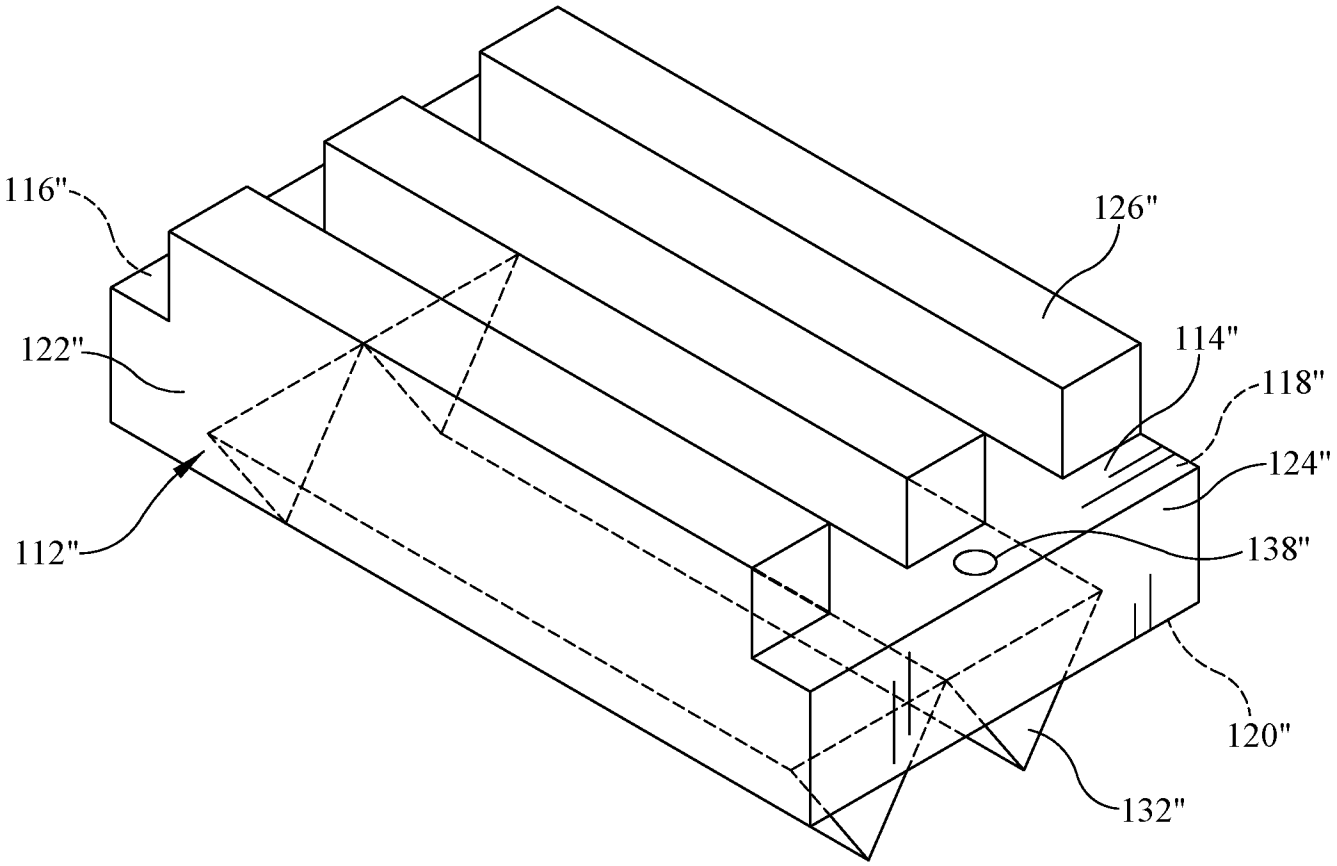
FIG. 6 is a close-up perspective view of a third block of the alternate embodiment of the trowel cleaner.
Figure 7:
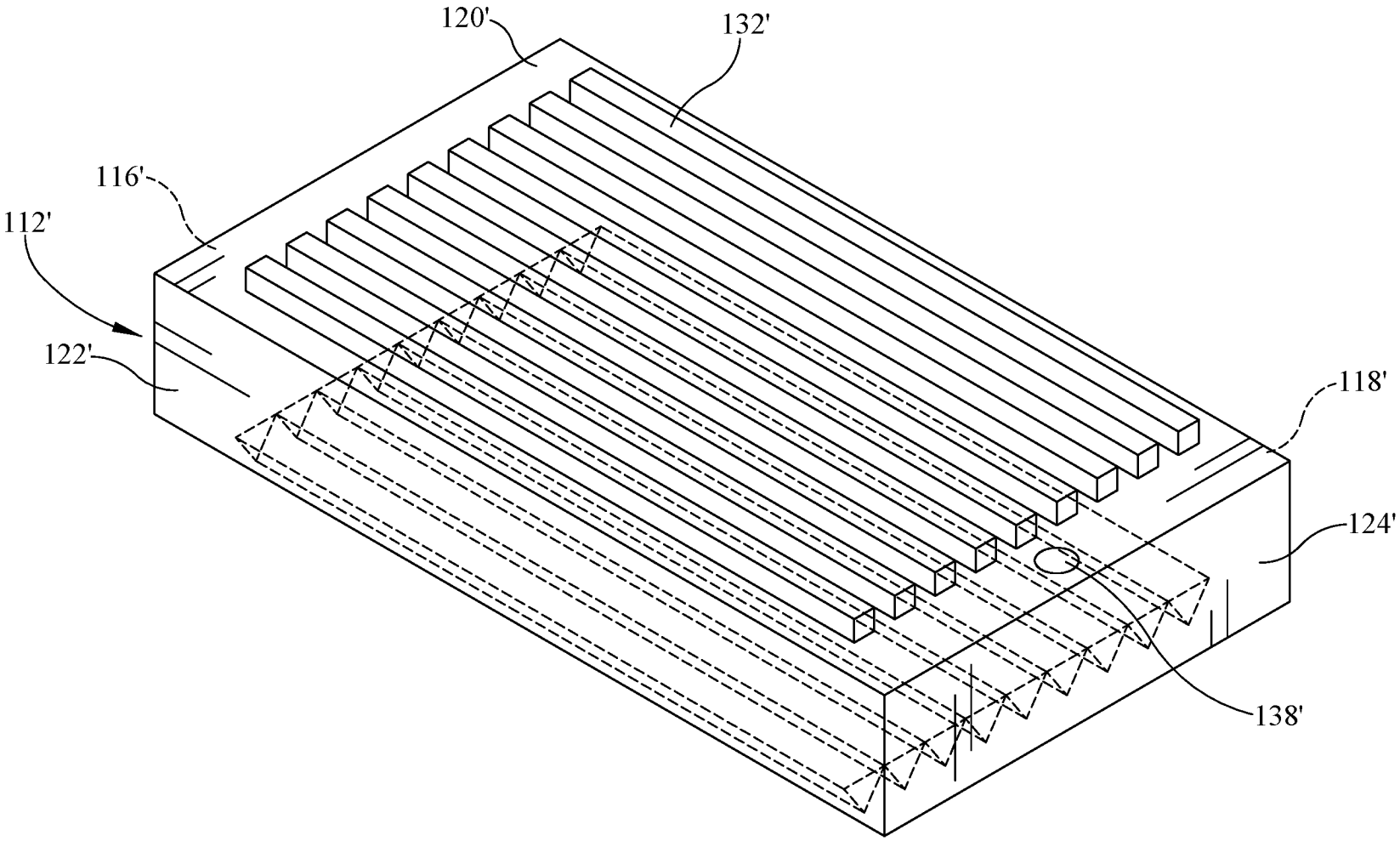
FIG. 7 is a perspective view of the second block of the alternate embodiment of the trowel cleaner.
Figure 8:
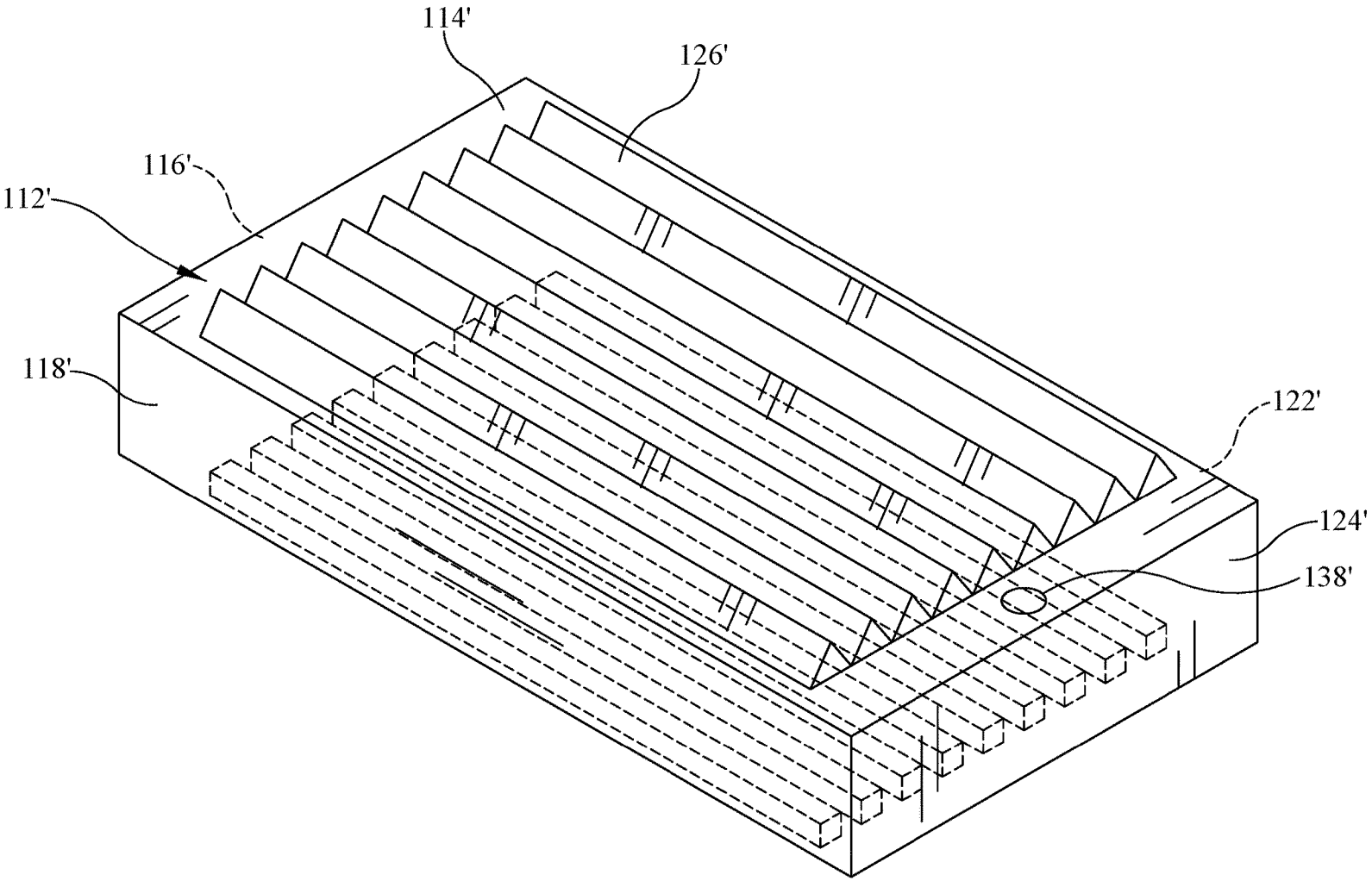
FIG. 8 is an alternate perspective view of the second block of the alternate embodiment of the trowel cleaner.
Figure 9:
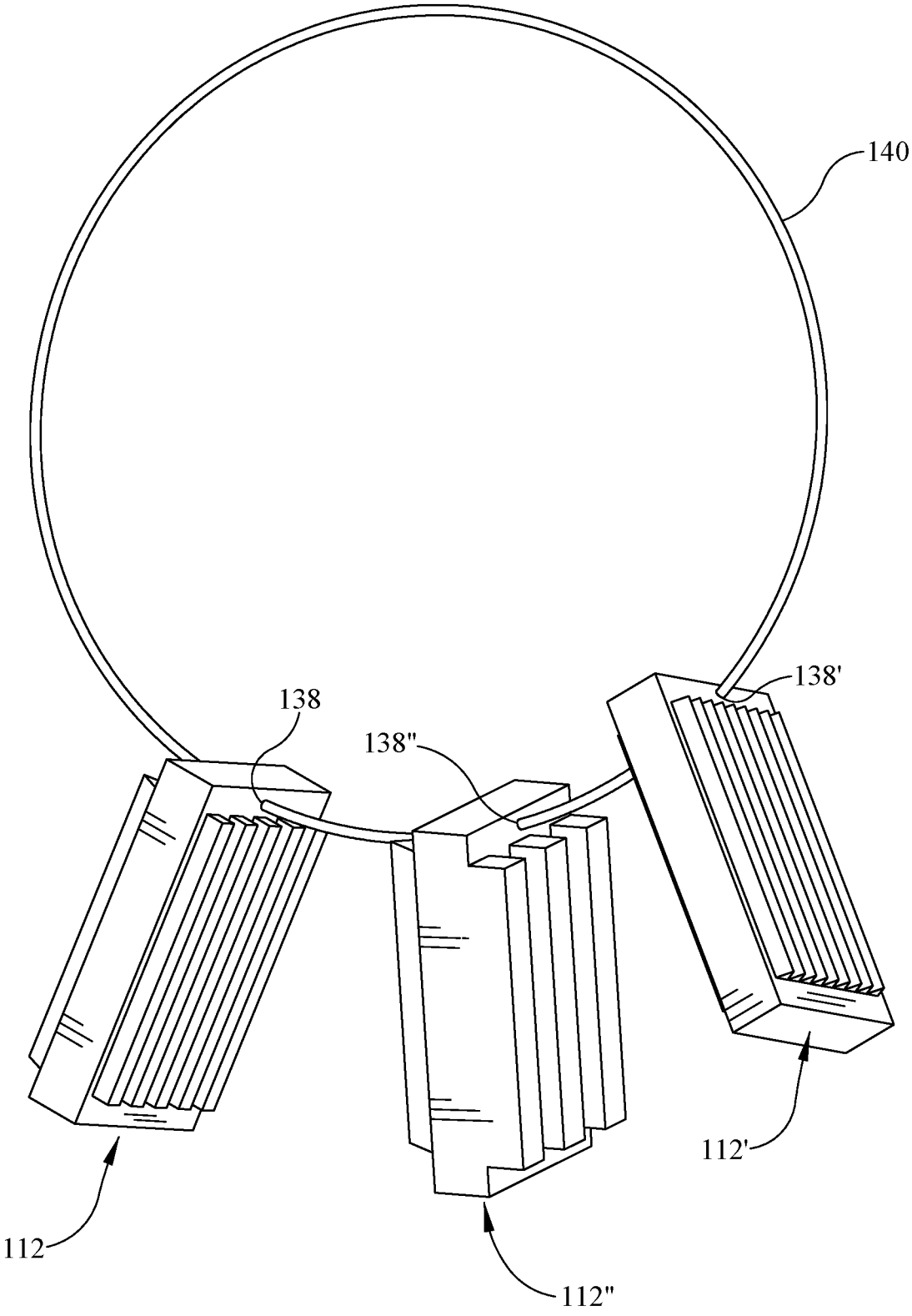
FIG. 9 is a perspective view of three blocks of the alternate embodiment of the trowel cleaner held together as a unit.

Referring now to the drawings, specifically FIGS. 1 and 2, it is seen that the trowel cleaner of the present invention, generally denoted by reference numeral 10, is comprised of a rectangular solid body member 12 that has a first face 14, a second face 16, a third face 18, a fourth face 20, a fifth face 22, and a sixth face 24. The first face 14 is opposite the fourth face 20, the second face 16 is opposite the sixth face 24, and the third face 18 is opposite the fifth face 22.

As seen, located on the first face 14 of the body member 12 is a uniform first ridge pattern 26 which extends between a pair of opposing faces, either between the third face 18 and the fifth face 22, as shown, or between the second face 16 and the sixth face 24. Similarly, located on the second face 16 of the body member 12 is a uniform second ridge pattern 28 which extends between a pair of opposing faces, either between the first face 14 and the fourth face 20, as shown, or between the third face 18 and the fifth face 22. Similarly, located on the third face 18 of the body member 12 is a uniform third ridge pattern 30 which extends between a pair of opposing faces, either between the first face 14 and the fourth face 20, as shown, or between the second face 16 and the sixth face 24. Similarly, located on the fourth face 20 of the body member 12 is a uniform fourth ridge pattern 32 which extends between a pair of opposing faces, either between the third face 18 and the fifth face 22, as shown, or between the second face 16 and the sixth face 24. Similarly, located on the fifth face 22 of the body member 12 is a uniform fifth ridge pattern 34 which extends between a pair of opposing faces, either between the first face 14 and the fourth face 20, as shown, or between the second face 16 and the sixth face 24. Similarly, located on the sixth face 24 of the body member 12 is a uniform sixth ridge pattern 36 which extends between a pair of opposing faces, either between the first face 14 and the fourth face 20, as shown, or between the third face 18 and the fifth face 22.

Each of the ridge patterns 26, 28, 30, 32, 34 and 36 are dimensioned to correspond to a serration pattern located along a serrated edge of a trowel in both shape and size. In this way, the serrated edge of the trowel is run through the ridge pattern 26, 28, 30, 32, 34 and 36 that corresponds to its serration pattern. For example, if a trowel T1 has a serrated edge S1 that has relatively small-sized triangle-shaped notches forming the serration pattern, the trowel is run through the first ridge pattern 26 located on the first face 14 of the block member 12. If a trowel T2 has a serrated edge S2 has a medium-sized rectangular-shaped notches forming its serrations pattern, the trowel is run through the second ridge pattern 28 on the second face 16 of the body member 12. When the serrated edge of the trowel is run through its proper ridge pattern, the teeth of the serrated edge of the trowel are received within the channels of the ridge pattern and correspondingly, the ridges of the ridge pattern are received within the notches of the serrated edge. The serrated edge of the trowel has a relatively tight fit within its selected ridge pattern so that as the trowel is pulled through the ridge pattern, the ridge pattern acts as a scraping tool scraping whatever mortar may be resident on the trowel. Several passes of the trowel through the ridge pattern may be necessary. If the serrated edge of the trowel is wider than the width of the ridge pattern, then the trowel can be cleaned one section at a time. The fact that each ridge pattern 26, 28, 30, 32, 34 and 36 is uniform means that its ridges all have the same dimension and its channels formed between the ridges all have the same dimensions.

The body member 12 and its ridge patterns 26, 28, 30, 32, 34 and 36, can be formed as a single unitary, even possibly monolithic unit or the underlying body member can be formed as a separate unit and each ridge pattern attached to the body member in appropriate manner. At least the ridge patterns are made from a relatively hard material, such as a hard plastic or even metal, as the trowel and stuck on mortar exert a substantial amount of scraping friction while being through the ridge pattern. Each of the six ridge patterns 26, 28, 30, 32, 34 and 36 can be different in size and/or shape relative to the others, however, a ridge pattern can be repeated one or more times on the body member if desired. It is not necessary that all of the faces have a ridge pattern thereon.

The body member 12 may be in the shape of a cube.

As seen in FIGS. 3-9, in an alternate embodiment of the trowel cleaner of the present invention, the trowel cleaner is comprised of a rectangular solid block member 112 that has a first side 114, a second side 116, a third side 118, a fourth side 120, a fifth side 122, and a sixth side 124, yet need not necessarily be a cube. As seen, located on the first face 114 of the body member 112 is a uniform first ridge pattern 126 which extends between a pair of opposing faces between the second face 116 and the sixth face 124. Similarly, located on the fourth face 120 of the body member 112 is a uniform fourth ridge pattern 132 which extends between a pair of opposing faces between the second face 116 and the sixth face 124. An opening 138 can pass through the body member 112.

Additional body members can be provided so that a second rectangular solid block member 112' has a first side 114', a second side 116', a third side 118', a fourth side 120', a fifth side 122', and a sixth side 124'. As seen, located on the first face 114' of the body member 112' is a uniform first ridge pattern 126' which extends between a pair of opposing faces between the second face 116' and the sixth face 124'. Similarly, located on the fourth face 120' of the body member 112' is a uniform fourth ridge pattern 132' which extends between a pair of opposing faces between the second face 116' and the sixth face 124'. An opening 138' can pass through the body member 112'.

Still additional body members can be provided so that a third rectangular solid block member 112" has a first side 114", a second side 116", a third side 118", a fourth side 120', a fifth side 122", and a sixth side 124". As seen, located on the first face 114" of the body member 112" is a uniform first ridge pattern 126" which extends between a pair of opposing faces between the second face 116" and the sixth face 124". Similarly, located on the fourth face 120" of the body member 112" is a uniform fourth ridge pattern 132" which extends between a pair of opposing faces between the second face 116" and the sixth face 124". An opening 138" can pass through the body member 112".

Additional body members can be similarly provided Each of the ridge patterns 126, 132, 126', 132', 126" and 132" are dimensioned to correspond to a serration pattern located along the serrated edge of a trowel in both shape and size. In this way, the serrated edge of the trowel is run through the ridge pattern 126, 132, 126', 132', 126" and 132" that corresponds to its serration pattern. For example, if a trowel T1 has a serrated edge S1 that has relatively small-sized triangle-shaped notches forming its serration pattern, the trowel is run through the fourth ridge pattern 132" located on the fourth face 114" of the block member 112". If a trowel T2 has a serrated edge S2 has a medium-sized rectangular-shaped notches forming its serration pattern, the trowel is run through the first ridge pattern 126 on the first face 114 of the body member 112. When the serrated edge of the trowel is run through its proper ridge pattern, the teeth of the serrated edge of the trowel are received within the channels of the ridge pattern and correspondingly, the ridges of the ridge pattern are received within the notches of the serrated edge. The serrated edge of the trowel has a relatively tight fit within its selected ridge pattern so that as the trowel is pulled through the ridge pattern, the ridge pattern acts as a scraping tool scraping whatever mortar may be resident on the trowel. Several passes of the trowel through the ridge pattern may be necessary. If the serrated edge of the trowel is wider than the width of the ridge pattern, then the trowel can be cleaned one section at a time. The fact that each ridge pattern 126, 132, 126', 132', 126" and 132" is uniform means that its ridges all have the same dimension and its channels formed between the ridges all have the same dimensions.

The body members and their respective ridge patterns can each be formed as a single unitary, even possibly monolithic unit or the underlying body member can be formed as a separate unit and each ridge pattern attached to the body member in appropriate manner. At least the ridge patterns are made from a relatively hard material, such as a hard plastic or even metal, as the trowel and stuck on mortar exert a substantial amount of scraping friction while being pulled through the ridge pattern. Each of the ridge patterns on a block member can be different in size and/or shape relative to the other ridge patter or they can be repeated if desired. The same ridge pattern can appear on more than one block member. Only a single face of the block need have a ridge pattern thereon.

A user need only have a single body member to carry about if the user only uses one or two trowels for a given job. Alternately, the user can carry two or more block members as needed depending on the trowels that need to be cleaned. If multiple block members 112, 112' and 112" are carried, a ring 140 can pass through their various openings 138, 138' and 138" respectively for ease of keeping the devices together.

While the invention has been particularly shown and described with reference to embodiments thereof, it will be appreciated by those skilled in the art that various changes in form and detail may be made without departing from the spirit and scope of the invention.

I claim:

1. A cleaning device for cleaning a serrated edge of a trowel, the serrated edge having a series of uniformly sized teeth such that a teeth channel is formed between each pair of adjacent teeth such that all teeth channels are all identically sized to one another, the cleaning device comprising:

a rectangular solid body member having a first face and an opposing fourth face, a second face and an opposing sixth face, and a third face and an opposing fifth face;

a series of coextensive elongate first ridges all having a uniform size such that a first channel is formed between each pair of adjacent first ridge, such that all first channels are all identically sized to one another located on the first face and extending between either the third face and the fifth face or between the second face and the sixth face;

a series of coextensive elongate second ridges all having a uniform size such that a second channel is formed between each pair of adjacent second ridge, such that all second channels are all identically sized to one another located on the second face and extending between either the first face and the fourth face or between the third face and the fifth face;

a series of coextensive elongate third ridges all having a uniform size such that a third channel is formed between each pair of adjacent third ridge, such that all third channels are all identically sized to one located on the third face and extending between either the first face and the fourth face or between the second face and the sixth face;

a series of coextensive elongate fourth ridges all having a uniform size such that a fourth channel is formed between each pair of adjacent fourth ridge, such that all fourth channels are all identically sized to one another located on the fourth face and extending between either the third face and the fifth face or between the second face and the sixth face;

a series of coextensive elongate fifth ridges all having a uniform size such that a fifth channel is formed between each pair of adjacent fifth ridge, such that all fifth channels are all identically sized to one another located on the fifth face and extending between either the first face and the fourth face or between the second face and the sixth face; and a series of coextensive elongate sixth ridges all having a uniform size such that a sixth channel is formed between each pair of adjacent sixth ridge, such that all sixth channels are all identically sized to one another located on the sixth face and extending between either the first face and the fourth face or between the third face and the fifth face; and wherein the cleaning device is adapted to receive the trowel with the series of first ridges and the first channels each dimensioned so that each first channel receives a respective one of the teeth of the trowel and each teeth channel receives a respective one of the ridges so that the trowel is slid along the series of first ridges while the series of teeth are within their respective first channels and the series of first ridges are within their respective teeth channels.

2. The cleaning device as in claim 1 wherein the body member is in the shape of a cube.

3. The cleaning device as in claim 1 in combination with the trowel.

4. The cleaning device as in claim 3 wherein the body member is in the shape of a cube.

5. A cleaning device for cleaning a serrated edge of a trowel, the serrated edge having a series of uniformly sized teeth such that a teeth channel is formed between each pair of adjacent teeth such that all teeth channels are all identically sized to one another, the cleaning device comprising:

a rectangular solid body member having a first face and an opposing fourth face, a second face and an opposing sixth face, and a third face and an opposing fifth face;

a series of coextensive elongate first ridges all having a uniform size such that a first channel is formed between each pair of adjacent first ridge, such that all first channels are all identically sized to one another located on the first face and extending between either the third face and the fifth face or between the second face and the sixth face;

a series of coextensive elongate second ridges all having a uniform size such that a second channel is formed between each pair of adjacent second ridge, such that all second channels are all identically sized to one another located on the second face and extending between either the first face and the fourth face or between the third face and the fifth face a series of coextensive elongate third ridges all having a uniform size such that a third channel is formed between each pair of adjacent third ridge, such that all third channels are all identically sized to one another located on the third face and extending between either the first face and the fourth face or between the second face and the sixth face;

a series of coextensive elongate fourth ridges all having a uniform size such that a fourth channel is formed between each pair of adjacent fourth ridge, such that all fourth channels are all identically sized to one another located on the fourth face and extending between either the third face and the fifth face or between the second face and the sixth face; and wherein the cleaning device is adapted to receive the trowel with the one of the series of first ridges and the first channels each dimensioned so that each first channel receives a respective one of the teeth of the trowel and each teeth channel receives a respective one of the ridges so that the trowel is slid along the series of first ridges while the series of teeth are within their respective first channels and the series of first ridges are within their respective teeth channels.

6. The cleaning device as in claim 5 further comprising a series of coextensive elongate fifth ridges all having a uniform size such that a fifth channel is formed between each pair of adjacent fifth ridge, such that all fifth channels are all identically sized to one another located on the fifth face and extending between either the first face and the fourth face or between the second face and the sixth face.

7. The cleaning device as in claim 5 wherein the body member is in the shape of a cube.

* * * * *